US007029238B1

(12) United States Patent
Zagars et al.

(10) Patent No.: US 7,029,238 B1
(45) Date of Patent: Apr. 18, 2006

(54) PUMP CONTROLLER FOR PRECISION PUMPING APPARATUS

(75) Inventors: Raymond A. Zagars, Mildford, MA (US); Robert F. McLoughlin, Pelham, NH (US)

(73) Assignee: Mykrolis Corporation, Billerica, MA (US)

( * ) Notice: Subject to any disclaimer, the term of this patent is extended or adjusted under 35 U.S.C. 154(b) by 0 days.

(21) Appl. No.: 09/447,504

(22) Filed: Nov. 23, 1999

Related U.S. Application Data

(60) Provisional application No. 60/109,568, filed on Nov. 23, 1998.

(51) Int. Cl.
*F04B 49/00* (2006.01)

(52) U.S. Cl. ..... 417/26; 222/189.06

(58) Field of Classification Search ..... 417/26, 417/53, 395, 412, 413.1; 222/189.06, 255, 222/334

See application file for complete search history.

(56) References Cited

U.S. PATENT DOCUMENTS

| | | | | | |
|---|---|---|---|---|---|
| 4,023,592 | A | * | 5/1977 | Patzke et al. | 137/565.12 |
| 4,597,719 | A | | 7/1986 | Tano et al. | 417/317 |
| 5,134,962 | A | | 8/1992 | Amada et al. | 118/688 |
| 5,516,429 | A | * | 5/1996 | Snodgrass et al. | 210/767 |
| 5,599,394 | A | | 2/1997 | Yabe et al. | 118/319 |
| 6,190,565 | B1 | * | 2/2001 | Bailey et al. | 210/744 |

FOREIGN PATENT DOCUMENTS

| | | |
|---|---|---|
| EP | 0863538 A2 | 9/1998 |
| EP | 0867649 A2 | 9/1998 |

* cited by examiner

*Primary Examiner*—Thor Campbell
(74) *Attorney, Agent, or Firm*—Sprinkle IP Law Group

(57) ABSTRACT

A pump controller and pump controlling method for dispensing a precise amount of low viscosity fluid are provided in which the problems of double dispenses and stuttered dispenses are avoided. In particular, the timing of the valves and motors in the pumping apparatus are adjusted to avoid these problems.

19 Claims, 5 Drawing Sheets

PUMP CONTROLLER FOR PRECISION PUMPING APPARATUS

CROSS-REFERENCE TO RELATED APPLICATION

This application claims the benefit of priority under 35 U.S.C. § 119 to provisional patent application No. 60/109,568 filed Nov. 23, 1998 by inventor Raymond A. Zagars, et al. entitled "Pump Controller for Precision Pumping Apparatus" the entire contents of which are hereby expressly incorporated by reference for all purposes.

BACKGROUND OF THE INVENTION

This invention relates generally to precision pumping apparatus and, more particularly to a pump controller for accurately controlling the amount of fluid dispensed from the precision pumping apparatus.

There are many applications where precise control over the amount and/or rate at which a fluid is dispensed by a pumping apparatus is necessary. In semiconductor processing, for example, it is important to control very precisely the amount and the rate at which photochemicals, such as photoresist, are applied to a semiconductor wafer being processed to manufacture semiconductor devices. The coatings applied to semiconductor wafers during processing typically require a flatness across the surface of the wafer that is measured in angstroms. Many semiconductor processes today have requirements on the order of 30 angstroms or less. The rate at which processing chemicals such as photoresists are applied to the wafer and spun out through centrifugal force to the edges of the wafer has to be controlled in order to ensure that the processing liquid is applied uniformly. It is also critical to control the rate and volume at which photoresist chemicals are applied to the wafer in order to reduce unnecessary waste and consumption. Many of the photochemicals used in the semiconductor industry today are not only toxic, but they are very expensive, frequently costing as much as $1,000 per liter. Thus, because of the cost of the chemicals as well as the difficulties in handling toxic materials, it is necessary to ensure that enough of the photoresist is applied to the wafer to satisfy processing requirements while minimizing excessive consumption and waste.

Another important requirement for semiconductor processing is the ability to repeatedly dispense a precisely controlled amount of processing chemical each time since variations in the amount of chemicals can adversely impact consistency from wafer to wafer. In the past, because of the unrepeatability as well as the inability to precisely control the amount of chemical being dispensed, many pumps had to dispense 50% to 100% more liquid than needed in order to ensure a sufficient quantity for processing requirements. This has resulted in waste and increased processing costs.

Conventional pumping apparatus are able to accurately dispense precise amounts of typical fluids. However, these conventional pumping apparatus cannot accurately dispense low viscosity, low dispense rate fluids and the conventional pumping apparatus will either cause a double dispense or a stuttered dispense of the low viscosity fluid. In particular, at the beginning of the dispensing cycle prior to the controlled dispensing of any fluid, a small amount of the low viscosity fluid, e.g., several microliters, may be undesirable ejected onto the wafer's surface resulting in an imprecise amount of fluid being dispensed. The problems of double dispensing and stuttered dispensing of these low viscosity, low flow rate fluids are caused by a variety of factors which are present in a conventional pumping apparatus. For example, pressure may be built up in the dispensing chamber of the pumping apparatus due to the closing of a barrier valve prior to dispensing which may force some fluid into the dispensing chamber and increases the pressure in the dispensing chamber. The extra fluid and hence the extra pressure in the dispensing chamber may cause the small amount of fluid to be ejected onto the wafer's surface at the start of the dispensing cycle. In addition, the timing of the control valves operation and the dispense system dynamics, such as tubing length, tubing diameter and nozzle size, in a conventional pumping apparatus may also contribute to the problem of the double or stuttered dispense of low viscosity, low dispense rate fluids.

It is desirable to provide low volume, low rate chemical dispensing pumping apparatus capable of precise and repeatable control of the rate and volume of low viscosity chemicals dispensed by the pumping apparatus, and it is to these ends that the present invention is directed.

SUMMARY OF THE INVENTION

In accordance with the invention, a low dispense rate precision dispensing pumping apparatus and method is provided which enable precise and repeatable control of dispense rate and volume of low viscosity fluids, and which overcomes the foregoing and other disadvantages of conventional dispensing pumping apparatus and method. The pumping apparatus precisely controls the dispensing amount and/or rate of low viscosity fluids by precisely controlling the operation of several different portions of the pumping apparatus during the dispense cycle. In particular, a pump controller may precisely control the timing of the control valves with respect to each other, the motion of the dispensing motor, and the timing of the control valves with respect to the movement of the dispensing motor. The pump controller in accordance with the invention accurately controls a pumping apparatus to avoid the double dispense or stuttered dispense problems associated with conventional pumping apparatus.

DETAILED DESCRIPTION OF A PREFERRED EMBODIMENT

The invention is particularly applicable to a pumping apparatus which accurately dispenses precise amounts of low viscosity fluids and it is in this context that the invention will be described. It will be appreciated, however, that the apparatus and method in accordance with the invention has greater utility, such as to accurately dispensing precise amounts of other fluids which may not be low viscosity fluids.

Figure 1:
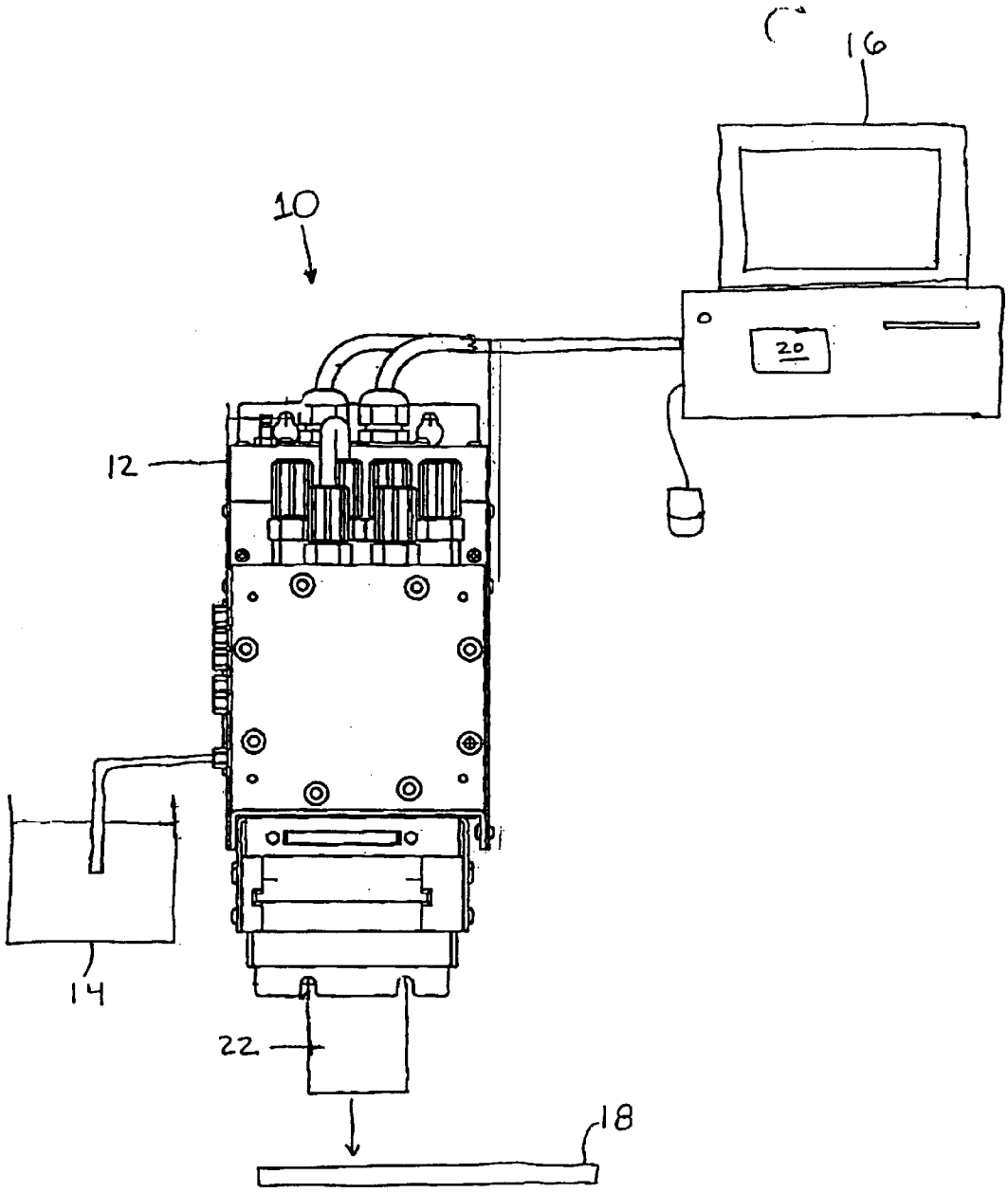
FIG. 1 is a block diagram illustrating a pumping apparatus including a pump controller in accordance with the invention.

FIG. 1 is a block diagram illustrating a pumping apparatus 10 including a pump controller in accordance with the invention. The pumping apparatus 10 may include a two-stage pump 12, a fluid reservoir 14 and a computer 16 which operate together to dispense a precise amount of fluid onto a wafer 18. For purposes of illustration, a low viscosity fluid, which may have a viscosity of less than 5 centipoire (cPs), may be dispensed at a low flow rate of about 0.5 milliliters per second, but the invention is not limited to dispensing low viscosity fluids or low flow rate fluids. The pump 12 is a two-stage pump since the dispensing of the fluid includes a first feed and filtration stage and then a second separate dispensing stage as described below so that the dispense performance does not change over the lifetime of the filter. The operation of the various portions of the pump 12 may be controlled by a software application 20, i.e., a computer program comprising pieces of software code which may be stored in a memory in the computer 16 and may be executed by a processor (not shown) in the computer. The operation of the pump may also be controlled by a software application or pieces of software code which are being executed by a processor located inside the pump. The location of the processor executing the instructions to control the operation of the pump is not critical to the invention.

The software application 20 may control, for example, the opening and closing of the various control valves in the pump and the movement of the motors or actuators which drive the pump in order to accurately dispense a precise amount of fluid onto the wafer 18. The method implemented by the software application for controlling the pump 12 to dispense low viscosity, low flow rate fluids in accordance with the invention will be described below with reference to FIG. 5.

To fill itself with fluid, the pump 12 may draw fluid from the reservoir 14 into a feed chamber as described below. The fluid may then be filtered through a filter and fed into a separate dispensing chamber as described below. From the dispensing chamber, the fluid may be dispensed through a filter 22 onto the wafer 18 in precise amounts even for low viscosity, low rate fluids. The actual cycles of the pump 12 will be described below with reference to FIGS. 3 and 4. Now, the details of the two-stage pump 12 will be described in order to better understand 3 the invention.

Figure 2:
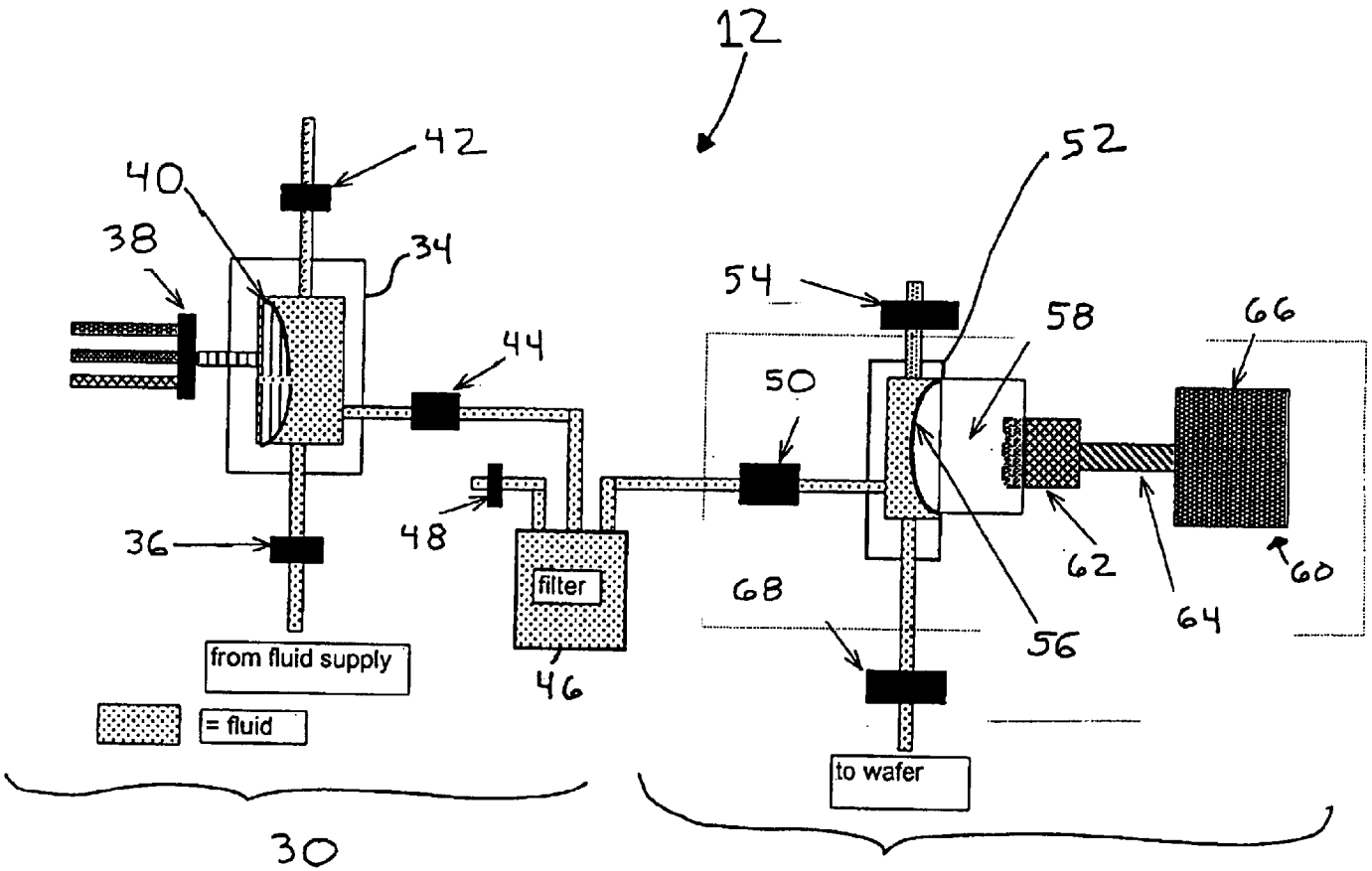
FIG. 2 is a block diagram illustrating a two-stage pumping apparatus.

FIG. 2 is a block diagram illustrating more details of the two-stage pump 12 with which the invention may be employed. In particular, the two-stage pump 12 may include a feed and filtration stage 30 and a dispensing stage 32. The feed and filtration stage 30 may include a feed chamber 34 which may draw fluid from a fluid supply reservoir through an open inlet valve 36 as more fluid is needed. During the dispensing stages, the inlet valve 36 is closed. To control entry of fluid into and out of the feed chamber, a feed valve 38 controls whether a vacuum, a positive feed pressure or the atmosphere is applied to a feed diaphragm 40 in the feed chamber. To draw fluid into the feed chamber, a vacuum is applied to the diaphragm 40 so that the diaphragm is pulled against a wall of the feed chamber and pulls fluid into the feed chamber. To push the fluid out of the feed chamber, a feed pressure may be applied to the diaphragm. To remove unwanted air bubbles, a vent valve 42 may be opened as needed.

Once the feed chamber 34 is filled with fluid, the inlet valve 36 is shut and the isolation valve 44 and a barrier valve 50 are opened to permit the fluid to flow through a filter 46 into the dispensing stage 32. Once the fluid is in the dispensing stage 32 and to isolate the feed and filtration stage from the dispensing stage, the isolation valve 44 and the barrier valve 50 may be closed. To vent unwanted air from the system or relieve excess pressure, the filter 46 may include a vent valve 48. As the fluid is pushed through the filter 46, unwanted impurities and the like are removed from the fluid. The fluid then flows through a barrier valve 50 into a dispensing chamber 52 in the second or dispensing stage of the pump, and the pump begins a dispense cycle as will now be described.

In the dispensing cycle, once the dispensing chamber is full of fluid and the barrier valve 50 is closed, a purge valve 54 is opened and the fluid in the dispensing chamber 52 is pushed by a dispense diaphragm 56 to eliminate any bubbles in the fluid in the dispensing chamber 52. To push or pull the dispense diaphragm 56, the dispensing diaphragm may be between the dispensing chamber and a hydraulic fluid chamber 58 filled with hydraulic fluid. The hydraulic fluid may be pressurized or de-pressurized by a dispensing pump 60 which may include a piston 62, a lead screw 64 and a stepper motor 66. To apply pressure to the fluid in the dispensing chamber 52, the stepper motor is engaged which engages the lead screw and pressurizes the hydraulic fluid. The hydraulic fluid in turn pushes the dispensing diaphragm into the dispensing chamber 52 which pressurizes the fluid in the dispensing chamber 52 or pushes the fluid out of the dispensing chamber 52 if the purge valve 54 or an outlet valve 68 are opened. If the outlet valve 68 is open, then an accurate amount of the fluid is dispensed onto the wafer. Now, the typical process for dispensing fluid will be described.

Figure 3:
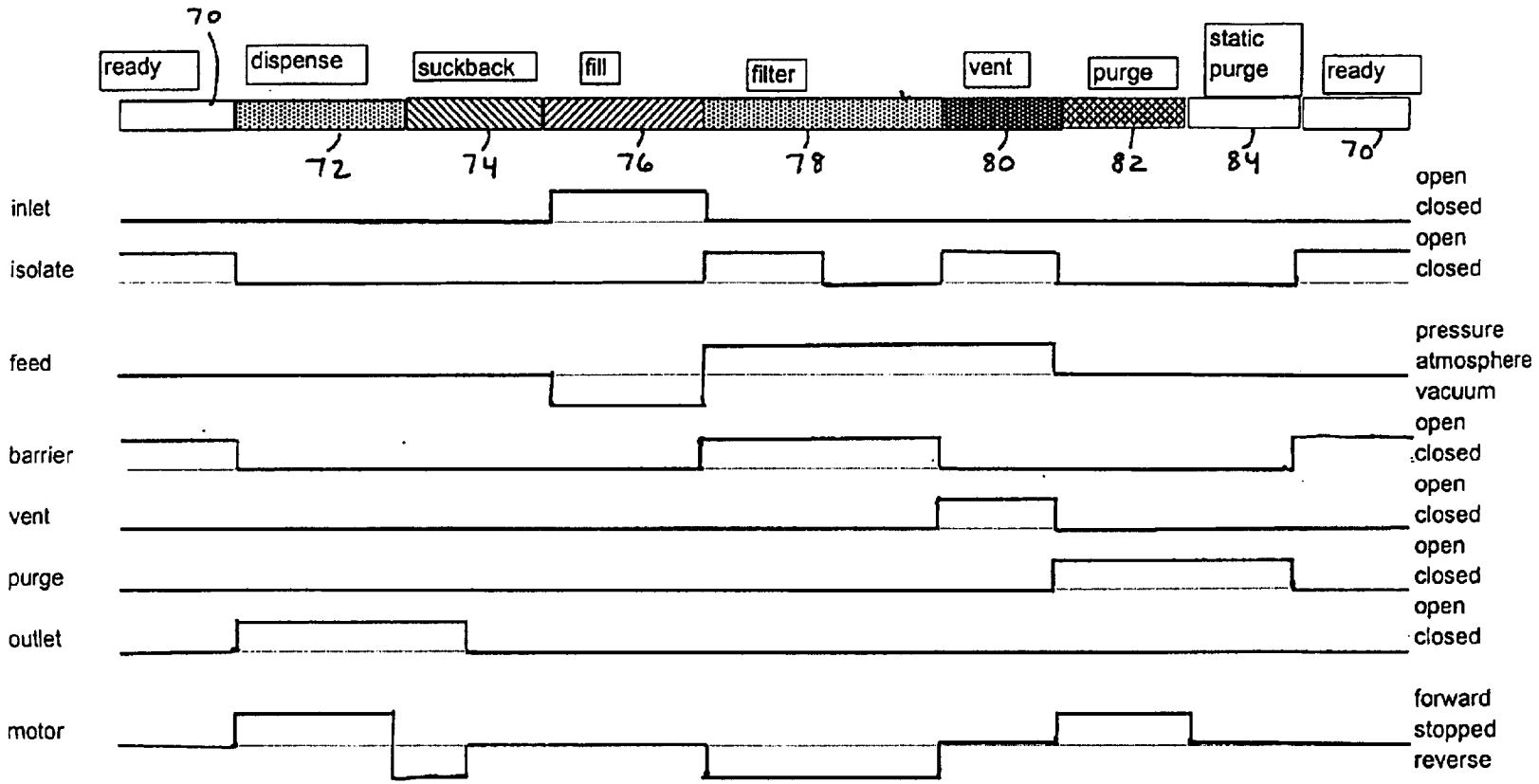
FIG. 3 is a timing diagram illustrating the conventional sequence for dispensing fluids.

FIG. 3 is a timing diagram illustrating the conventional sequence for controlling a two-stage pump of the type shown in FIG. 2 to dispense fluids. As shown at the top of the diagram, the dispensing process may include a sequence of stages, i.e., steps such as a ready stage 70, a dispense stage 72, a suckback stage 74, a fill stage 76, a filter stage 78, a vent stage 80, a purge stage 82, a static purge stage 84. The typical controlling of the motors and valves for each of these different stages will now be described along with the result that occurs as a result of each stage. For example, during the ready stage, the barrier and isolate valves are opened while the outlet valve is shut to bring the system and feed chamber to an equilibrium pressure state so that fluid may be dispensed. As the dispense stage begins, the isolate and barrier valves close, the outlet valve is opened and the motor in the dispensing pump is started. Due to the relative incompressibility of the fluid being dispensed and the "stiffness" of the pump, the closing of the barrier valve pushes fluid out of the valve as it closes which pressurizes the fluid in the dispensing chamber and may cause the typical double dispense or stuttered dispense problem as described above since the outlet valve is open. The closure of the barrier valve may increase the pressure in the dispensing chamber by a predetermined amount, which may be about 2–3 psi. The actual pressure increase, however, depends on the characteristics of the barrier valve being used. In addition, since the motor is started at the same time as the outlet valve is opened, an uneven dispensing of fluid (or stuttered dispensing) may occur since the outlet valve takes more time to open than the starting of the motor and therefore the motor may be initially pushing the fluid through an outlet valve which is not quite completely open. This may cause an initial "spitting" of a small amount of fluid. During the dispensing stage, fluid may be dispensed onto the wafer.

At the end of the dispensing stage and at the beginning of the suckback stage, the motor is stopped and reversed or an external stop/suckback valve (not shown) may be opened to suck any fluid remaining in the nozzle back into the dispensing chamber to ensure that no drips occur at the end of the fluid dispensing. After the fluid has been sucked back into the dispensing chamber, the outlet valve is closed and the motor is stopped. Next, during the fill stage, the inlet valve is opened and a vacuum is applied to the feed diaphragm to draw fluid into the feed chamber from the reservoir. At the beginning of the filter stage, the inlet valve is closed, the isolate valve is opened, the feed motor applies positive pressure to the fluid in the feed chamber, the barrier valve is opened and the dispense motor is reversed to push fluid through the filter into the dispense chamber. Once the fluid has exited the feed chamber, the isolate valve may be closed.

At the beginning of the vent stage, the isolate valve is opened, the barrier valve is closed, the vent valve is opened, the dispense motor is stopped and pressure is applied to the feed diaphram to remove air bubbles from the filter. At the beginning of the purge stage, the isolate valve is closed, the feed pump does not apply pressure or a vacuum to the feed chamber, the vent valve is closed, the purge valve is opened and the dispense pump is moved forward to remove air bubbles from the dispensing chamber. At the beginning of the static purge stage, the dispense motor is stopped but the purge valve remains open to continue the removal of air from the dispensing chamber. At the beginning of the ready stage, the isolate and barrier valves are opened and the purge is closed so that the feed pump and the system reaches ambient pressure and the pump is ready to dispense fluid.

As described above, this conventional dispensing process suffers from double dispense or stuttered dispense problems. In particular, the closure of the barrier valve prior to dispensing pushes fluid out of the valve as it closes which pressurizes the fluid in the dispensing chamber. This may cause a small amount of unwanted fluid to dispense onto the wafer since the outlet valve is open. In addition, since the motor is started at the same time as the outlet valve is opened, an uneven dispensing of fluid (or stuttered dispensing) may occur since the outlet valve takes more time to open than the starting of the motor and therefore the motor may be initially pushing the fluid through an outlet valve which is not quite completely open. A dispensing method in accordance with the invention which solves these problems will now be described.

Figure 4:
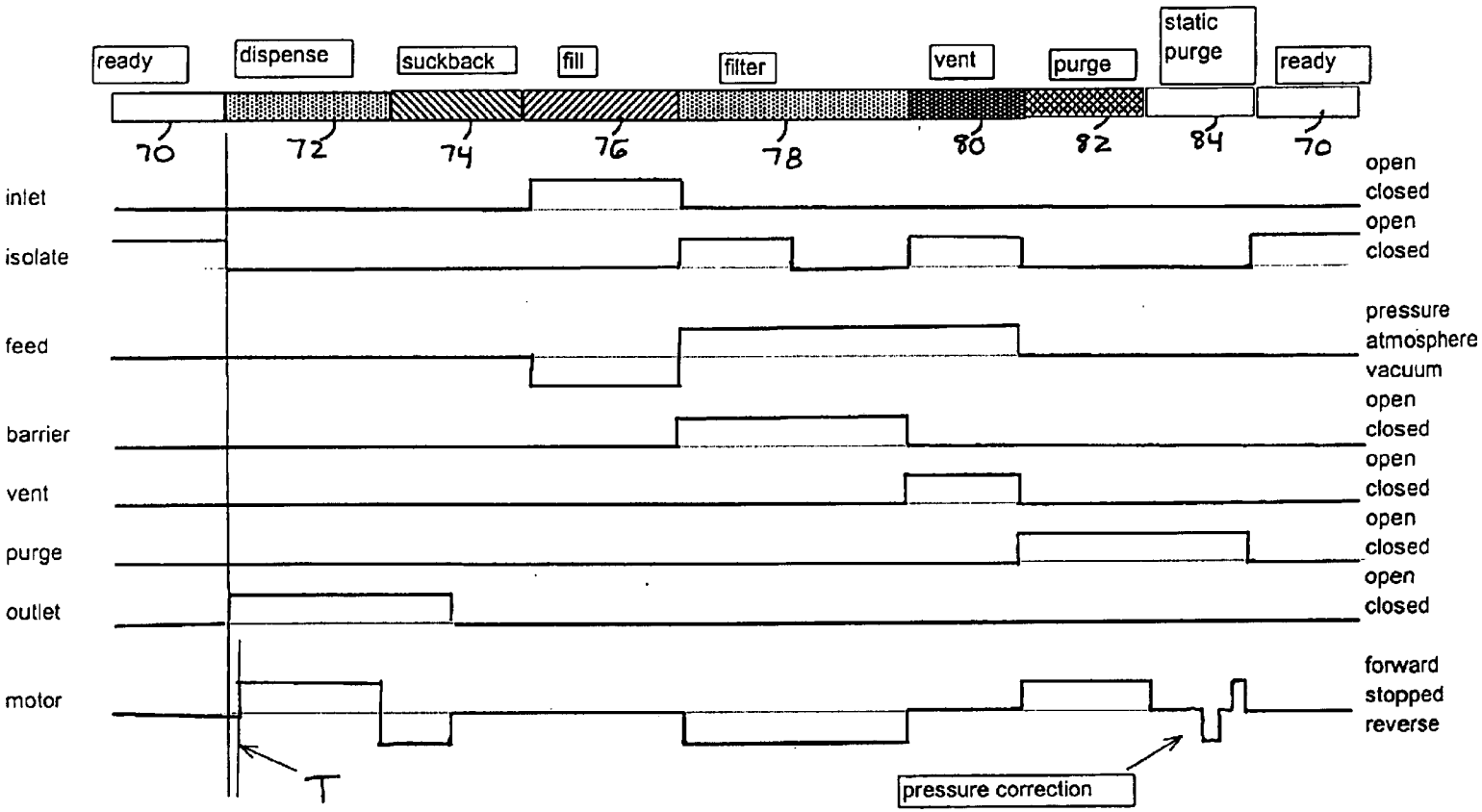
FIG. 4 is a timing diagram illustrating a sequence for dispensing fluids in accordance with the invention.

FIG. 4 is a timing diagram illustrating a method for dispensing fluids in accordance with the invention. As with the conventional dispensing process described above, the dispensing process shown in FIG. 4 has the same stages, i.e., steps, 70–84 as the conventional process. In addition, much of the controlling of the valves and motors is similar to the conventional method above, and only the changes in the controlling of the valves and motors in accordance with the invention will be described here. In particular, in order to prevent the unwanted double dispense or stuttered dispense problems, the method changes the manner of controlling of the valves and motors.

In particular, in accordance with invention, the barrier valve is not closed at the beginning of the dispense stage as it done in the conventional process. Rather, the barrier valve is closed at the beginning of the vent stage and kept closed during the dispense stage. This avoids the sudden rise in pressure in the dispense chamber and, therefore, fluid does not leak out of the outlet valve due to the sudden rise in pressure. Since the barrier valve does not open and close prior to the beginning of the dispense stage, but does close at the beginning of the vent stage, the pressure in the dispense chamber does increase after the vent and purge states and this additional pressure must be released. To release this pressure, during the static purge stage 84, the dispense motor may be reversed to back out the piston 62 some predetermined distance to compensate for any pressure increase caused by the closure of the barrier valve. As an example, each step of the stepper motor may reduce the pressure by about 0.1 psi. If the closure of the barrier valve increases the pressure by 2 psi, then the motor may be reversed 20 steps to reduce the pressure in the dispense chamber by this amount to compensate for the closure of the barrier valve. The actual pressure decrease, however, depends on the characteristics of the particular stepper motor, lead screw and piston being used. The pressure decrease caused by each step of the motor may be determined by a pressure sensor which is located inside the dispensing chamber. In accordance with the invention, since the outlet valve is not open when the additional pressure is added into the dispensing chamber during the vent stage, no "spitting" of the fluid onto the wafer may occur.

The motor may be further reversed a predetermined additional distance so that the motor may be moved forward just prior to dispensing to adjust the dispense pressure to zero and avoid any backlash which normally occurs when the motor is moved backwards before the dispensing of fluid. In particular, with a piston, lead screw and stepper motor dispense pump, the last motion prior to a dispense operation is normally forward to avoid the fact that, as the piston changes direction, there is some backlash. Thus, the problem of the additional pressure caused by the closure of the barrier valve is avoided.

Next, during the beginning of the dispense stage 72, the timing of the outlet valve and the start of the motor are changed to avoid the stuttering dispense problem. In particular, the valve is a mechanical device that requires a finite period of time to open. The motor, on the other hand, may start more quickly than the outlet valve may open. Therefore, starting the motor and opening the outlet valve simultaneously will cause a rise in pressure of the dispense fluid which in turn causes the stuttered dispensing. To avoid this problem, the outlet valve is opened and then, some predetermined period of time, T, later, the dispense motor is started so that the outlet valve is completely open when the motor is started which achieves a good dispense. The predetermined period of time depends on the characteristics of the outlet valve and dispense motor being used, but, if the outlet valve takes approximately 50 ms to open, then the predetermined period of time may be, for example, between 50 and 75 mS and preferably approximately 75 mS. This predetermined period of time may also be referred to as a delay. Thus, in accordance with the invention, the dispense motor is no longer pushing fluid through a partially open outlet valve so that an accurate, controlled amount of fluid may be dispensed onto the wafer. Thus, in accordance with the invention, the problems caused by the closure of the barrier valve and the simultaneously opening of the outlet valve and starting of the dispense motor are avoided to provide more accurate dispensing of fluids, such as low viscosity fluids.

As described above, the valves and motors in the pumping apparatus are controlled by a software application so that the above changes in the dispensing process may be applied to any two-stage pumping apparatus since no hardware changes are needed. Thus, for example, if the tubing, tubing length, nozzle height or nozzle diameter is changed, the process in accordance with the invention may be easily adapted. Now, the method for controlling the dispense process in accordance with the invention will be described.

Figure 5:
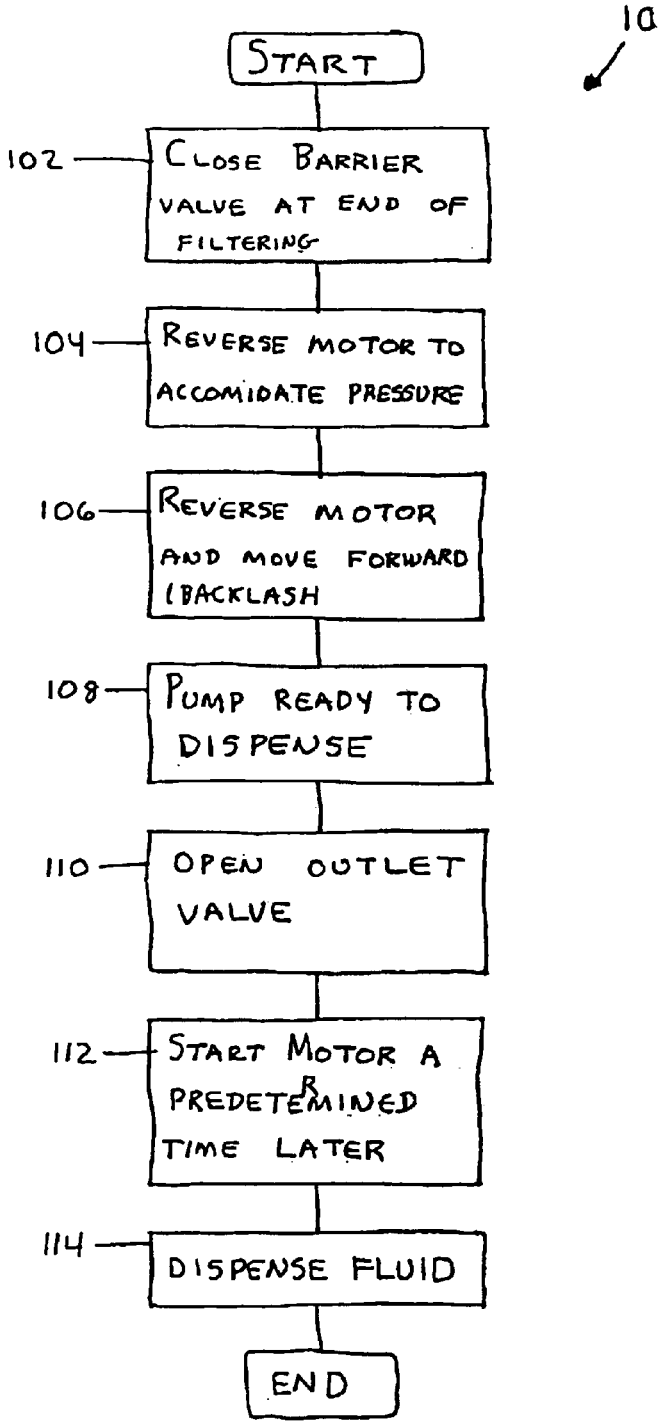
FIG. 5 is a flowchart illustrating a method for controlling a pumping apparatus to dispense low viscosity fluids in accordance with the invention.

FIG. 5 is a flowchart illustrating a method 100 for controlling the dispensing of low viscosity fluids from a pumping apparatus in accordance with the invention. At step 102, the barrier valve is closed at the end of the filtering stage which increases the pressure in the dispense chamber. In step 104, during the static purge stage, the dispense motor is reversed a predetermined distance to compensate for the pressure increase caused by the closure of the barrier valve. Next, in step 106, the motor may be reversed an additional distance so that, in step 108, when the motor is moved forward to eliminate backlash, the pressure of the dispense chamber remains at zero. In step 108, the pump is now ready for dispensing. In step 110, the outlet valve is opened. Next, in step 112, the dispense motor is started some predetermined period of time later and fluid is dispensed in step 114. The method is then completed.

While the foregoing has been with reference to a particular embodiment of the invention, it will be appreciated by those skilled in the art that changes in this embodiment may be made without departing from the principles and spirit of the invention.

What is claimed is:

1. A process for controlling a multistage pump to dispense a fluid, the multistage pump having a feed chamber, a dispensation chamber, and an outlet valve of the multistage pump coupled to the dispensation chamber, the process comprising:

a first stage, wherein while a first valve between the feed chamber and the dispensation chamber is closed and the outlet valve is closed, the dispensation chamber is brought to an equilibrium pressure state; and a second stage, wherein a dispensation pump disposed in the dispensation chamber is activated to dispense the fluid through the outlet valve and onto an object upon opening the outlet valve and activating the dispensation pump.

2. The process of claim 1, wherein a stepper motor is used in bringing the dispensation chamber to the equilibrium pressure state.

3. The process of claim 1, wherein the equilibrium pressure state is approximately 0 psi.

4. The process of claim 1, wherein during the second stage, the outlet valve is opened before the dispensation pump is activated.

5. The process of claim 1, wherein:

a purge valve is coupled to the dispensation chamber;

during the first stage, the purge valve is open; and during the second stage, the purge valve is closed.

6. The process of claim 1, wherein the fluid has a viscosity less than approximately five centipoise.

7. The process of claim 4, wherein during the second stage, a period of time elapses between a time when the outlet valve is opened and before a time when the dispensation pump is activated.

8. The process of claim 4, further comprising a third stage, wherein the dispensation pump is operated in reverse to suck back part of the fluid into the dispensation chamber, and wherein the outlet valve is closed after the part of the fluid is sucked back into the dispensation chamber.

9. The process of claim 4, wherein:

a filter lies between the feed chamber and the dispensation chamber; and the first valve lies between the filter and the dispensation chamber.

10. The process of claim 8, wherein excess fluid spitting is substantially eliminated from the dispensation chamber.

11. The process of claim 9, further comprising:

a fill stage, wherein an inlet valve to the multistage pump is coupled to the feed chamber and during the fill stage, while the inlet valve is open, a second valve lying between the feed chamber and the filter is closed, and a vent valve is closed, the feed chamber is put under vacuum to allow the fluid enter the feed chamber;

a filter stage, wherein during the filter stage, while the inlet valve is closed, the first valve is opened, and the second valve is opened, pressure is applied to the feed chamber so that the fluid flows through the filter; and a vent stage, wherein during the vent stage, while the fluid in the feed chamber is under pressure, the inlet valve is closed, the first valve is closed, the second valve is opened, and a vent valve is opened.

12. A process for controlling a multistage pump to dispense a fluid, the multistage pump having a feed chamber, a dispensation chamber, and an outlet valve of the multistage pump coupled to the dispensation chamber, the process comprising a first stage, wherein after the outlet valve is opened, a dispensation pump disposed in the dispensation chamber is activated to dispense the fluid through the outlet valve and onto an object.

13. The process of claim 12, wherein during the first stage, a period of time elapses between a time when the outlet valve is opened and before a time when the dispensation pump is activated.

14. The process of claim 12, further comprising a second stage performed before the first stage, wherein while a first valve between the feed chamber and the dispensation chamber is closed and the outlet valve is closed, a stepper motor is used to bring the dispensation chamber to substantially atmospheric pressure.

15. The process of claim 14, wherein:

a purge valve is coupled to the dispensation chamber;

during the first stage, the purge valve is closed; and during the second stage, the purge valve is open.

16. The process of claim 12, wherein:

a filter lies between the feed chamber and the dispensation chamber; and the first valve lies between the filter and the dispensation chamber.

17. The process of claim 16, further comprising:

a fill stage, wherein an inlet valve to the multistage pump is coupled to the feed chamber and during the fill stage, while the inlet valve is open, a second valve lying between the feed chamber and the filter is closed, and a vent valve is closed, the feed chamber is put under vacuum to allow the fluid enter the feed chamber;

a filter stage, wherein during the filter stage, while the inlet valve is closed, the first valve is opened, and the second valve is opened, pressure is applied to the feed chamber so that the fluid flows through the filter; and a vent stage, wherein during the vent stage, while the fluid in the feed chamber is under pressure, the inlet valve is closed, the first valve is closed, the second valve is opened, and a vent valve is opened.

18. The process of claim 12, further comprising a second stage performed after the first stage, wherein the dispensation pump is operated in reverse to suck back part of the flow into the dispensation chamber, and wherein the outlet valve is closed after an amount of fluid is sucked back into the dispensation chamber.

19. The process of claim 12, wherein the fluid has a viscosity less than approximately five centipoise.

* * * * *